US011828007B2

(12) United States Patent
Feibus et al.

(10) Patent No.: US 11,828,007 B2
(45) Date of Patent: Nov. 28, 2023

(54) KNIT FABRIC STRUCTURE INCORPORATING A CONTINUOUS CONDUCTIVE MATRIX FOR ENHANCED STATIC DISSIPATION

(71) Applicant: Applied Conductivity, LLC, Charlotte, NC (US)

(72) Inventors: Miriam H. Feibus, Charlotte, NC (US); Larry D. Starnes, Charlotte, NC (US)

(73) Assignee: Applied Conductivity, LLC, Charlotte, NC (US)

( * ) Notice: Subject to any disclaimer, the term of this patent is extended or adjusted under 35 U.S.C. 154(b) by 371 days.

(21) Appl. No.: 17/283,879

(22) PCT Filed: Apr. 9, 2019

(86) PCT No.: PCT/US2019/026507

§ 371 (c)(1),
(2) Date: Apr. 8, 2021

(87) PCT Pub. No.: WO2020/081113

PCT Pub. Date: Apr. 23, 2020

(65) Prior Publication Data

US 2021/0348309 A1 Nov. 11, 2021

Related U.S. Application Data

(63) Continuation-in-part of application No. PCT/US2018/055853, filed on Oct. 15, 2018.
(Continued)

(51) Int. Cl.

| | |
|---|---|
| ***D02G 3/44*** | (2006.01) |
| ***D02G 3/36*** | (2006.01) |
| ***D04B 21/16*** | (2006.01) |

(52) U.S. Cl.
CPC ..... *D02G 3/441* (2013.01); *D02G 3/36* (2013.01); *D04B 21/16* (2013.01);
(Continued)

(58) Field of Classification Search
CPC . D02G 3/36; D02G 3/38; D02G 3/441; D04B 21/16; D10B 2401/16
See application file for complete search history.

(56) References Cited

U.S. PATENT DOCUMENTS 3,864,944 A 2/1975 Jackson
4,216,264 A * 8/1980 Naruse ..... D01F 1/09 428/397

(Continued)

FOREIGN PATENT DOCUMENTS

KR 101584733 1/2016
WO WO-9640362 A1 * 12/1996 ..... A61N 1/14

OTHER PUBLICATIONS

Varnaite-Zuravliova, S et al; The Influence of Three-Layer Knitted Fabrics' Structure on Electrostatic and Comfort Properties; ISSN 1392-1320 Materials Science (Medziagotyra). vol. 19, No. 4. 2013; pp. 415-419; p. 415, col. 2, paragraph 2; p. 416, Table 1; p. 416, col. 2, paragraph 5; p. 417, col. 1, paragraph 1.

(Continued)

*Primary Examiner* — Shaun R Hurley
(74) *Attorney, Agent, or Firm* — Schwartz Law Firm, P.C.

(57) ABSTRACT

A multi-bar warp knit fabric structure includes a body yarn and a multi-wrapped hybrid yarn. The hybrid yarn incorporates a specialty core unit, an inside textile cover, and an outside textile cover. The inside textile cover is a static-dissipative yarn helically wrapped around the core unit, and the outside textile cover is a surface-conductive yarn helically wrapped around the inside textile cover and the core unit. The hybrid yarn is integrally knit with the body yarn in (Continued)

a repeating stitch pattern alternately zigzaging lengthwise up selected wales of the fabric structure and floating across the fabric structure in a widthwise course direction. The hybrid yarn cooperates with like knitted multi-wrapped hybrid yarns to form a continuous conductive matrix of static dissipative boxes in the fabric structure.

20 Claims, 3 Drawing Sheets

Related U.S. Application Data

(60) Provisional application No. 62/572,106, filed on Oct. 13, 2017.

(52) U.S. Cl.
CPC ..... *D10B 2101/08* (2013.01); *D10B 2101/12* (2013.01); *D10B 2331/02* (2013.01); *D10B 2331/04* (2013.01); *D10B 2401/13* (2013.01); *D10B 2401/16* (2013.01)

(56) References Cited

U.S. PATENT DOCUMENTS 4,420,534 A * 12/1983 Matsui ..... D01F 1/09 428/397
4,970,109 A 11/1990 Bryant et al.
5,029,457 A 7/1991 Gajjar
5,053,021 A 10/1991 Feibus
5,806,295 A 9/1998 Robins et al.
7,100,352 B2 9/2006 Robins
10,167,579 B2 * 1/2019 Kilickan ..... D03D 15/47
10,400,364 B1 * 9/2019 Mayer ..... D03D 15/25
2003/0074879 A1 4/2003 Patrick
2003/0186608 A1 10/2003 Goldberg
2005/0042412 A1 * 2/2005 Bruner ..... D06C 7/00 428/92
2005/0155336 A1 7/2005 Robins
2009/0181592 A1 7/2009 Dugan
2010/0084179 A1 4/2010 Harris et al.
2011/0130060 A1 * 6/2011 Chung ..... D02G 3/441 139/420 R
2013/0180027 A1 7/2013 Rock et al.
2013/0298520 A1 * 11/2013 Bruner ..... D02G 3/36 57/225
2015/0107214 A1 4/2015 Rudinger
2015/0203995 A1 * 7/2015 Adams ..... D03D 13/008 442/302
2017/0233903 A1 * 8/2017 Jeon ..... D03D 15/00 139/425 R
2017/0246469 A1 * 8/2017 Goldberg ..... D03D 1/0088
2017/0314168 A1 * 11/2017 Schoots ..... D01F 1/09
2018/0057969 A1 * 3/2018 Andersen ..... D01D 10/06
2019/0003083 A1 * 1/2019 Carlsson ..... D02G 3/12

OTHER PUBLICATIONS

Carpus, E et al; ESD Protective Equipment Investigation of two-layer knitted structures with conductive fibres content; Industria Textila; 2014, vol. 65. No. 3; pp. 145-152; p. 146; col. 2, paragraphs 3-4; p. 147, Table 1.

* cited by examiner

KNIT FABRIC STRUCTURE INCORPORATING A CONTINUOUS CONDUCTIVE MATRIX FOR ENHANCED STATIC DISSIPATION

TECHNICAL FIELD AND BACKGROUND OF THE DISCLOSURE

The present disclosure related broad and generally to a knit fabric structure incorporating a continuous conductive matrix for enhanced static dissipation. In exemplary embodiments, the disclosure incorporates an amalgam of disparate technologies that creates a task specific synergistic performance fabric which is non-treated, evenly balanced, predictable and consistent. The performance of this combination of yarns and technology is far greater than the sum of their individual attributes and a substantial improvement over prior fabrics.

The present fabric includes a multiplicity of evenly spaced, static absorptive boxes forming a continuous conductive grid, pattern, or "matrix" in warp and wale directions with an evenly balanced field of static dispersion. The constituent yarns including the body or holding yarn are designed to create uniformly dispersed air spaces, interstices, or channels within the exemplary fabric for fast, balanced, precise and predictable dissipation of electrical, thermal and liquid charges. The grid becomes an active dissipative pathway of static let-off channels. The exemplary fabric does not depend on the much slower wicking, climbing and filling, because the grid is always "working" by cleaning and filtering atmospheric moisture.

In exemplary embodiments, the present disclosure comprises an inherently high-performance, multi-tasking, anti-static, single or double-sided fabric structure having a continuous conductive grid, pattern, or "matrix" of evenly spaced static dissipative formations or (e.g, boxes) the exact properties of which may be varied by introducing other specialized yarns for added features and benefits. The exemplary fabric structure is strong, durable, entirely untreated (no chemical treatments), stable, anti-static, anti-bacterial, hypo-allergenic, reliable, and safe for the environment, pets and human users—containing no potentially toxic performance finishes. If not properly washed without softeners, the fabric use and benefits may be restored by washing in industrial or residential machines adding a 2:1 ratio of vinegar to baking soda to the water. The exemplary fabric structure may also repel fleas, mites, bed bugs and other pests.

The exemplary fabric structure of the present disclosure may offer one or more of the following features/attributes:

User Comfort:
- Absorbs perspiration and disperses liquids and moisture
- Improved thermal qualities, both dissipative and collective
- Hypo-allergenic
- Anti-Microbial
- Anti-Bacterial
- Anti-Fungal
- Reduces inflammation
- Regulates body temperature Fabric Stability:
- Does not change shape or shrink
- Inherently fire retardant
- Safe; no potentially toxic performance altering/enhancing finishes
- Strong; does not rip, run or tear
- Abrasion and tear resistant

- Specialized yarns retain their integrity longer

Maintenance:
- Launderable; home or industrial
- Energy efficient; dries rapidly
- Does not fade, sluff, pill or leach; colorfast
- Does not retain odors
- Releases and resists stains One or more of the above features and attributes may be achieved in an inherently high-performance, anti-static, single or double-sided fabric structure having a continuous conductive grid pattern or "matrix" of evenly spaced static dissipative formations (e.g., boxes) in a modified warp knit Queenscord construction. The present disclosure offers fabric benefits and flexibility that can be utilized in unlimited applications and a variety of industries. Exemplary applications include holistic pet care, medical and patient care, cosmetics, sports apparel, footwear, electronic and aerospace manufacturing, military, laboratory clean rooms, food service, transportation, and others.

The present disclosure may utilize various machinery, textiles, techniques and technologies known in the art and disclosed in one or more of the following publications:

- "Knit Fabric", U.S. Patent 577702, Feb. 23, 1897;
- "Warp Knit Fabric", U.S. Pat. No. 3,222,893, Dec. 14, 1965;
- "Surgical Drainage Tube", U.S. Pat. No. 3,957,054, May 18, 1976;
- "Method for Making a Double Faced Warp Knit Fabric", U.S. Pat. No. 3,864,944, Feb. 11, 1975;
- "Drainage "T" Tube Used for Abdominal Surgery", U.S. Pat. No. 4,654,032, Mar. 31, 1987;
- "Knitted Fabric Having Improved Electrical Charge Dissipation", U.S. Pat. No. 4,856,299, Dec. 14, 1987;
- "Knitted Fabric Having Improved Electrical Charge Dissipation", U.S. Pat. No. 4,815,299, Aug. 15, 1989;
- "Knitted barrier fabric" U.S. Pat. No. 4,970,109, Nov. 13, 1990;
- "Woven Surgical Drain and Woven Surgical Sponge", U.S. Pat. No. 5,180,375, May 2, 1991;
- "Surgical Drain", WO1991009727, Nov. 12, 1992; and
- "Woven Surgical Drain and Woven Surgical Sponge", EP0693945, Jan. 31, 1996.

The complete disclosure of each of the above-listed prior patents and publications is incorporated herein by reference.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a multi-bar warp knit fabric structure integrally formed in courses and wales using at least two guide bars of a textile knitting machine. The fabric structure comprises a body yarn adapted for being supplied from a first warp beam and manipulated by a first guide bar of the textile knitting machine. A multi-wrapped, integrally formed hybrid yarn is adapted for being supplied from a second warp beam and manipulated by a second guide bar of the textile knitting machine. The hybrid yarn incorporates a specialty core unit, an inside textile cover, and an outside textile cover. The inside cover comprises a static-dissipative yarn helically wrapped around the core unit, while the outside cover comprises a surface-conductive (e.g., suffused) yarn helically wrapped around the inside textile cover and the core unit. The hybrid yarn is integrally knit with the body yarn in a repeating stitch pattern alternately zigzaging lengthwise up selected wales (e.g., 6th stitch of a 0-6 pattern) of the fabric structure and floating across the fabric structure in a widthwise course direction. The hybrid yarn cooperates with like knitted multi-wrapped hybrid yarns to form a continuous conductive matrix of static dissipative boxes in the fabric structure.

The terms "inside textile cover" and "outside textile cover" refer to locations of the covers relative to one another in the overall structure of the multi-wrapped hybrid yarn—the inside cover residing nearer to the specialty core unit and the outside cover residing farther from the specialty core unit. The inside and outside covers may reside directly adjacent one another, or may be separated by intervening yarns or other textile components.

Applicant theorizes that the integrally-knit static adsorptive and dissipative yarns of the exemplary fabric structure create a tension that excites the electrical cells, interstices or "channels" in the fabric structure to effect an immediate let-off, dispersion or spread of the static charge without any additional grounding. These dissipative pathways throughout the conductive matrix do not depend on a wicking process. The multiplicity of active and repeating static dissipative boxes in the conductive matrix interact synergistically while the rest of the field remains passive.

The term "static dissipative box" refers to any substantially continuous and substantially closed yarn pattern including any multi-sided or rounded knit shape including square, circular, triangular, octagonal, or the like.

According to another exemplary embodiment, the inside and outside covers of the hybrid yarn are helically wrapped in opposite directions; e.g., clockwise and counterclockwise turns.

According to another exemplary embodiment, the inside cover of the hybrid yarn comprises a bi-component fully sheathed carbon yarn.

According to another exemplary embodiment, the outside cover of the hybrid yarn comprises a bi-component partially sheathed carbon yarn.

As used herein the term "fully sheathed carbon yarn" means that the underlying carbon yarn is substantially entirely covered along its length (e.g., 90% or more in cross-section), whereas "partially sheathed carbon yarn" means that a portion of the underlying yarn is uncovered along its length (e.g., less than 90% in cross-section), such that the carbon sufficiently communicates with a surface of the yarn to enable ready surface conductivity.

According to another exemplary embodiment, the specialty core unit of the hybrid yarn comprises copper suffused in a fiber selected from a group consisting of polyester and nylon. Alternatively, the specialty core unit may comprise antimicrobial and antibacterial carriers, such as ceramic and calcium. Ceramic particles in yarns may provide additional benefits including far infrared (FIR) reflectivity. Alternatively, the specialty core unit may comprise any metal selected from a group consisting of silver, copper, gold, zinc, molybdenum, cobalt, and nickel.

The antimicrobials utilized in the exemplary fabric structure may experience increased efficacy, efficiency and durability as a result of their incorporation in a precisely balanced electrically conductive matrix or grid, as described herein. This same conductive balance in the present fabric structure may further promote the release of medical stains (e.g., blood, providone-iodine), food stains, body oils, odors, pet hair, petroleum-based gels, and other related substances. The exemplary fabric structure may also resist fading, maintain its shape after laundering, and provide increased melting point and flame retardant properties.

According to another exemplary embodiment, the body yarn of the present fabric structure comprises a high-filament texturized polyester or other hydrophobic yarn, and/or inert yarns such as nylon, and/or stretch yarns, such as spandex, lycra or elastane. The exemplary fabric structure may also incorporate high tensile strength yarns comprising aramid and other such fibers for high-performance military applications.

According to another exemplary embodiment, a multi-filament antimicrobial yarn or other task-specific yarn (e.g., ceramic) is run up selected wales of the fabric structure and passes centrally through a column of substantially aligned static dissipative boxes in the fabric structure.

According to another exemplary embodiment, the antimicrobial yarn comprises copper suffused in a fiber selected from a group consisting of polyester and nylon.

According to another exemplary embodiment, the antimicrobial yarn is integrally knit with selected wales of the fabric structure (e.g., at the 3rd stitch of a repeating 0-6 pattern), and is adapted for being supplied in a conventional manner from a third warp beam and manipulated by a third guide bar of the textile knitting machine. Alternatively, the antimicrobial yarn may be laid-in the fabric structure and locked in place by one or more knitting yarns.

According to another exemplary embodiment, the hybrid yarn is stitched such that the continuous conductive matrix of static dissipative boxes operatively contacts both a technical face and a technical back of the fabric structure.

In another exemplary embodiment, the present disclosure comprises a multi-bar warp knit fabric structure integrally formed in courses and wales using at least two guide bars of a textile knitting machine. The fabric structure comprises a body yarn adapted for being supplied from a first warp beam and manipulated by a first guide bar of the textile knitting machine. A multi-wrapped hybrid yarn is adapted for being supplied from a second warp beam and manipulated by a second guide bar of the textile knitting machine. The hybrid yarn comprises:

(i) a specialty core unit comprising an antimicrobial (e.g., copper) yarn;
(ii) an inside textile cover comprising a static-dissipative, bi-component, fully sheathed carbon yarn helically wrapped around the core unit; and
(iii) an outside textile cover comprising a surface-conductive, bi-component, partially sheathed carbon yarn helically wrapped in an opposite direction around the inside textile cover and the core unit.

In the exemplary hybrid yarn, the ions released from the antimicrobial (e.g., copper) core unit are attracted to a strong absorptive field generated by the inside and outside carbon covers in the continuous conductive matrix. The carbon yarns in the exemplary fabric structure may effect immediate static let-off and dispersion of electrical charges. Additionally, the conductive matrix may function to hold the copper ions of the core unit within the fabric structure. In prior art fabrics, these ions are typically dissipated and lost by washing.

In exemplary embodiments, the yarns incorporated in the present fabric structure may comprise staple and/or filament fibers, and may be suffused or infused to achieve enhanced antimicrobial and conductive properties.

In yet another exemplary embodiment, the present disclosure comprises a textile component adapted for being integrated in a warp knit fabric structure. The textile component incorporates a multi-wrapped hybrid yarn comprising:

(i) a specialty core unit comprising an antimicrobial (e.g., copper) yarn;

(ii) an inside textile cover comprising a static-dissipative, bi-component, fully sheathed carbon yarn helically wrapped around the core unit; and (iii) an outside textile cover comprising a surface-conductive, bi-component, partially sheathed carbon yarn helically wrapped in an opposite direction around the inside textile cover and the core unit. The hybrid yarn is integrally knit with the body yarn in a repeating stitch pattern alternately zigzaging lengthwise up selected wales of the fabric structure and floating across the fabric structure in a widthwise course direction. The hybrid yarn cooperates with like knitted hybrid yarns to form a continuous conductive matrix of static dissipative boxes in the fabric structure. In alterative embodiments, the exemplary fabric structure could be fabricated on other textile machines including (e.g.) circular knit, weft knit, and flat bed, provided the integrity of the continuous conductive matrix is maintained. The exemplary fabric structure may be pre-set before dyeing and finishing, and then scoured, dyed and finished.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

Figure 1:
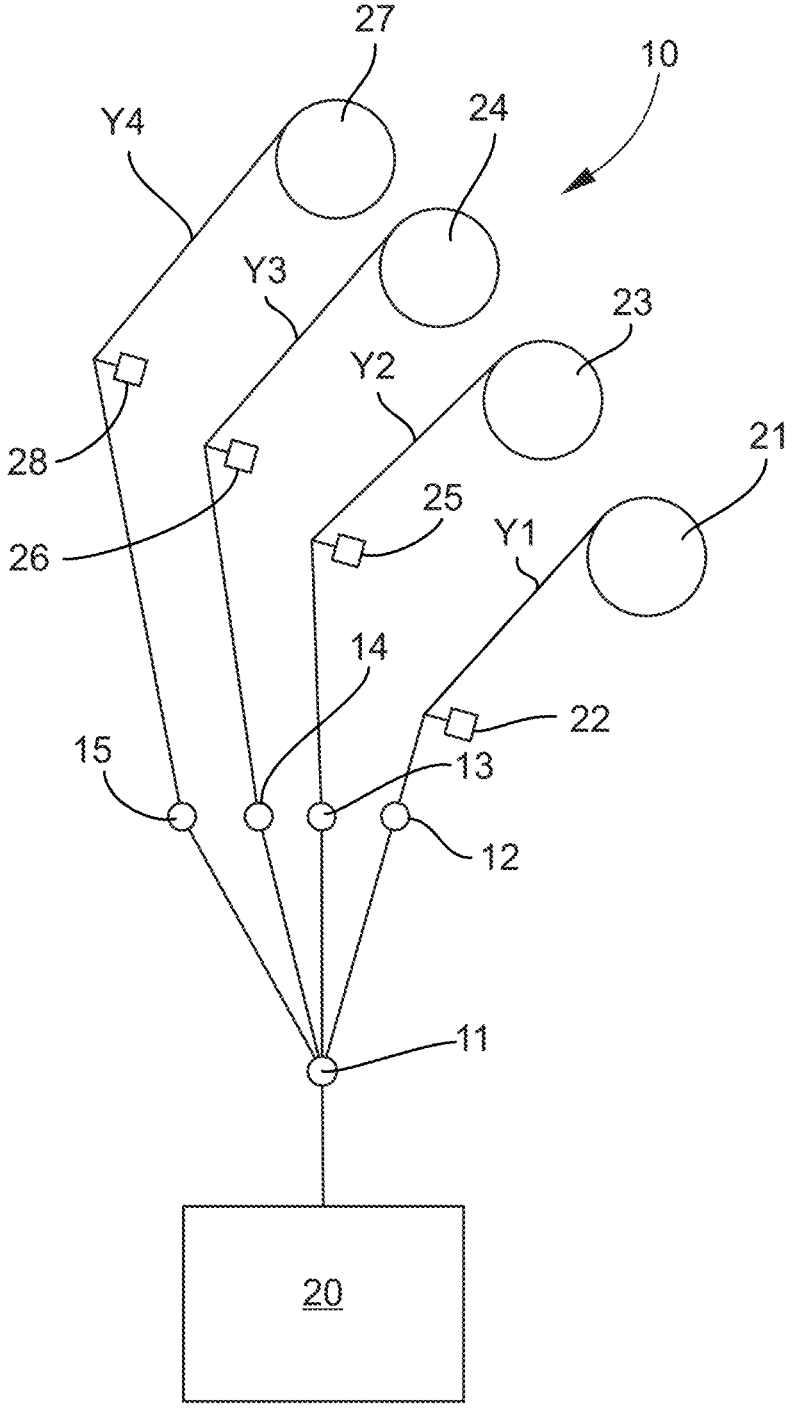
FIG. 1 is a schematic drawing showing various components of a conventional 4-bar warp knitting machine.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, in exemplary embodiments the present disclosure comprises a multi-bar, warp-knit fabric structure incorporating a continuous conductive matrix for enhanced static dissipation. The exemplary fabric structure may be produced on a Tricot or Raschel machine, as described further below, using a single needle bar and multiple guide bars. In one example, the present fabric structure comprises a full-set or partial-set, modified Queenscord fabric construction similar to that disclosed in prior U.S. Pat. No. 3,864,944 entitled "Method for making a Double-Faced Warp Knit Fabric." The complete disclosure of this prior patent is incorporated herein by reference.

Figure 2:
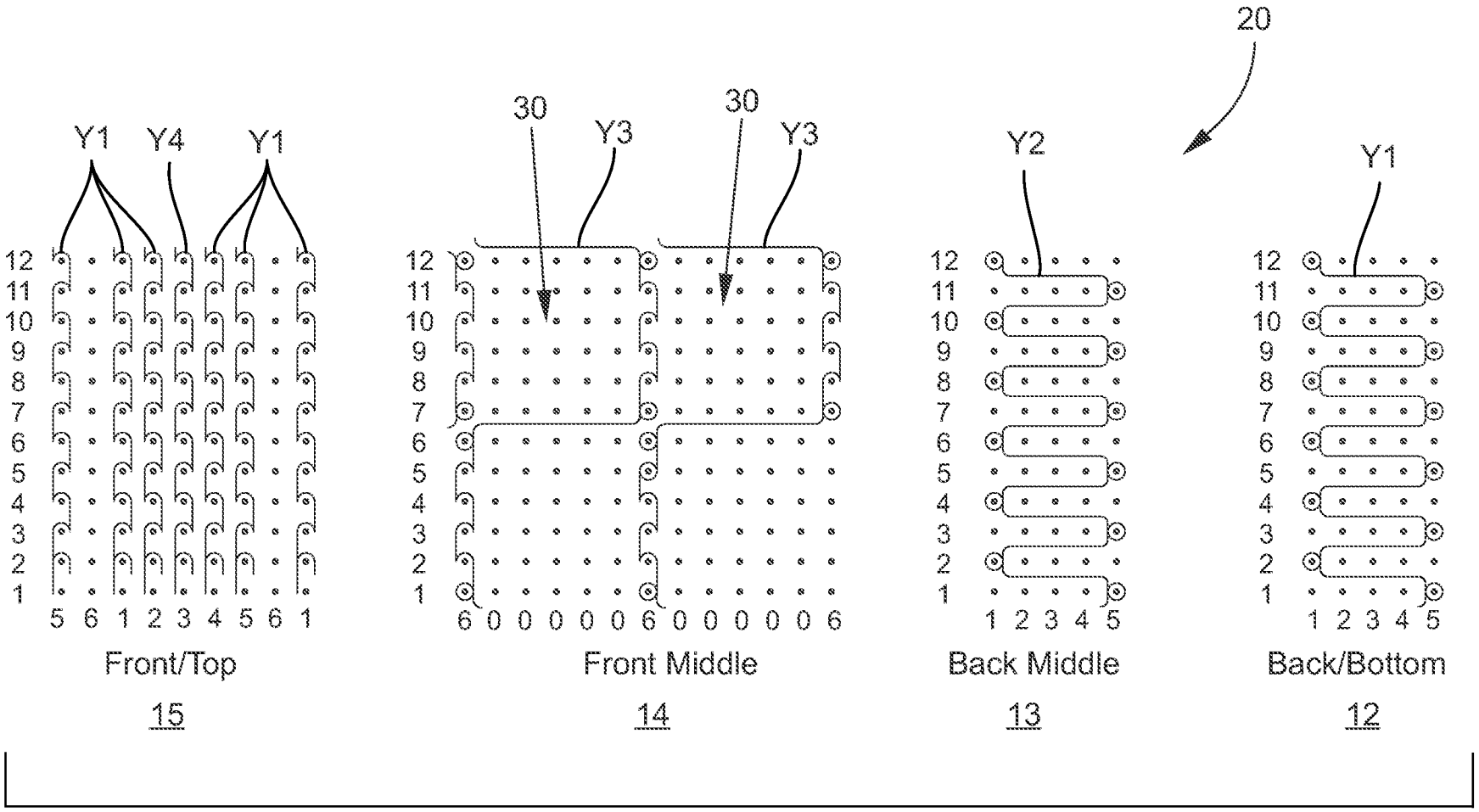
FIG. 2 is a diagrammatic representation of the exemplary fabric structure showing the knitting repeat sequence (or lapping movement) of the first, second, third, and fourth guide bars.

As illustrated schematically in FIG. 1, an exemplary warp knitting machine 10 employs a single needle bar 11 and at least four guide bars 12, 13, 14 and 15—referred to in FIG. 2 as "back/bottom", "back middle", "front middle", and "front/top", respectively. The needle bar 11 comprises knitting needles which may vary in number according to the gauge of the machine, and each guide bar 12-15 has a number of yarn guides corresponding to the number of needles of the needle bar 11. The guide bars 12-15 are able to be shogged under pattern control a distance of one or more needles in opposite directions lengthwise of the needle bar 11, and are also swingable transversely of the needle bar 11 to permit their yarn guides to pass between the needles. The combined shogging and swinging movements permit the yarns to be fed to the needles and warp-knit in the present fabric structure. The needle bar 11 functions in the textile machine 10 cooperating with guide bars 12-15 in a conventional manner to produce the exemplary fabric structure 20.

Guide bar 12 controls yarns Y1 fed from warp beam 21. The yarns Y1 pass through a fixed reed 22 which serves to keep the yarns separated, and are threaded through guides in guide bar 12 onto needle bar 11—all in a manner conventionally known and understood in the art. Yarns Y2 are fed from warp beam 23, pass through reed 25 and are threaded through guides in guide bar 13 onto needle bar 11. Yarns Y3 are fed from warp beam 24, pass through reed 26 and are threaded through guides in guide bar 14 onto needle bar 11. Yarns Y4 are fed from warp beam 27, pass through reed 28 and are threaded through guides in guide bar 15 onto needle bar 11.

The exemplary fabric structure 20 is best illustrated diagrammatically in FIG. 2. The dots represent needles, while the lines represent the path of the yarns Y1-Y4 as the guide bars 12-15 move between and around the needles. The active and repeating static dissipative boxes are represented at reference numeral 30. As discussed herein, these static dissipative boxes 30 cooperate to form a continuous conductive matrix in the exemplary fabric structure 20.

In exemplary embodiments, the first and second yarns Y1, Y2 of the present fabric structure 20 comprise body yarns threaded at guide bars 12 and 13—back/bottom and back middle, respectively. The body yarns Y1, Y2 are integrally knit in stitches 1, 2, 4, 5 of the repeating 0-6 pattern. Each yarn Y1, Y2 may comprise one or more ends of texturized non-conductive (inert) polyester yarn; e.g., each yarn 150 denier, 136 filaments.

Figure 3A:
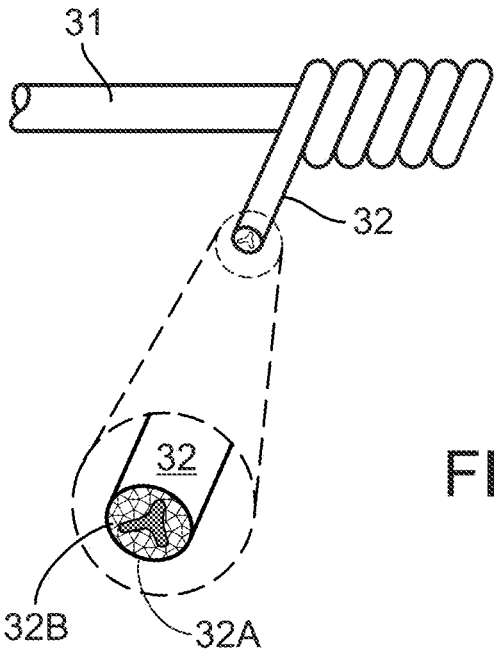
FIGS. 3A and 3B are enlarged views demonstrating a sequential two-stage wrapping process for producing an exemplary hybrid yarn incorporated in the present warp-knit fabric structure, and showing respective ends of the inside and outside wrapper yarns in cross-section.
Figure 3B:
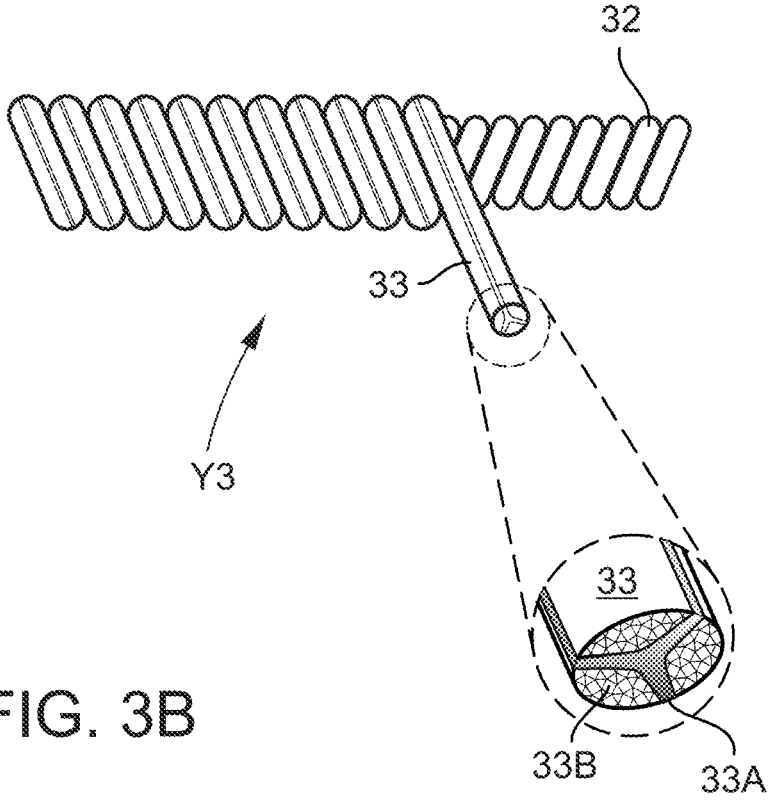

Exemplary yarn Y3 of the present fabric structure 20 comprises one end of a multi-wrapped hybrid yarn which is integrally knit with body yarns Y1, Y2 in a modified Queenscord pattern, such as disclosed in the prior '299 Patent. As shown in FIGS. 3A and 3B and described further below, the exemplary multi-wrapped hybrid yarn Y3 includes a specialty core unit 31 comprising an antimicrobial yarn, an inside textile cover 32 comprising a fully sheathed static-dissipative carbon yarn, and an outside textile cover 33 comprising a partially sheathed surface-conductive carbon yarn. The inside textile cover 32 is helically-wrapped around the core unit 31 at 16 turns per inch, while the outside cover 33 is helically wrapped around the inside cover 32 and core unit 31 at 8 turns per inch.

The exemplary multi-wrapped hybrid yarn Y3 may comprise:

(i) Antimicrobial core unit 31—150 denier, 48 filaments
(ii) Static-dissipative inside cover 32—35 denier, 6 filaments
(iii) Surface-conductive outside cover 33—25 denier, 3 filaments The multi-wrapped hybrid yarn Y3 is threaded at guide bar 14 (front middle) and knit in a repeating stitch pattern, illustrated in FIG. 2, alternately zigzaging lengthwise up selected wales of the fabric structure 20 (pillar stitch) and floating across the fabric structure 20 in a widthwise course direction. Like hybrid yarns Y3 are knit at every 6th stitch of a repeating 0-6 pattern, and cooperate to create a continuous conductive matrix of static dissipative boxes 30 in the fabric structure 20.

Exemplary yarn Y4 is threaded at guide bar 15 (front/top) and comprises an antimicrobial yarn, or other task-specific yarn, integrally knit with selected wales of the fabric structure 20 at every 3rd stitch of the repeating 0-6 pattern. The antimicrobial yarn Y4 may comprise one or more ends of texturized polyester or nylon incorporating a pure metal including silver, copper, gold, zinc, molybdenum, cobalt, nickel, or other antimicrobial. One example of a suitable antimicrobial yarn having copper properties is disclosed in prior U.S. Pat. No. 9,469,923 (the '923 Patent) entitled "Post-extruded Polymeric Man-made Synthetic Fiber with Copper." The complete disclosure of this prior patent is incorporated herein by reference. In another example, the yarn Y4 comprises ceramic particles which may provide additional benefits including far infrared (FIR) reflectivity. The exemplary yarn Y4 has a denier of 150 and 48 filaments.

Exemplary Multi-Wrapped Hybrid Yarn Y3

Referring again to FIGS. 3A and 3B and the exemplary multi-wrapped hybrid yarn Y3. FIGS. 3A and 3B demonstrate a sequential two-stage wrapping process for producing the hybrid yarn Y3; the inside textile cover being helically-wrapped around the specialty core unit 31 in one direction, and the outside cover 33 being helically wrapped around the inside cover 32 and core unit 31 in an opposite direction.

The specialty core unit 31 of hybrid yarn Y3 may comprise a post-extruded suffused copper yarn, or other antimicrobial element infused or suffused in polyester or nylon fibers. One example of a suitable synthetic core yarn 31 having copper properties is disclosed in the prior '923 Patent referenced above. In other exemplary embodiments, the specialty core unit 31 may comprise other antimicrobials, such as pure metals including silver, gold, zinc, molybdenum, cobalt, nickel; and/or non-metal antimicrobial and antibacterial carriers, such as ceramics and calcium; and/or other task-specific textile or non-textile elements.

The inside textile cover 32 of exemplary hybrid yarn Y3 may comprise a bi-component, static-dissipative carbon yarn, such as that manufactured by or for William Barnet & Son, LLC and sold commercially under the trademark Nega-Stat® P190. The P190 yarn has a unique, trilobally shaped conducting core 32A comprising carbon entirely surrounded by a sheath 32B of polyester. The carbon 32A is designed to provide optimum antistatic protection in grounded and ungrounded applications, and provides enhanced static dissipative performance resulting from its unique core construction. As previously described, the inside textile cover 32 is helically-wrapped around the core unit 31 of hybrid yarn Y3 at 16 turns per inch, and may comprise a yarn denier of 35 and 6 filaments.

The outside cover 33 of hybrid yarn Y3 is helically wrapped around the inside cover 32 and core unit 31 at 8 turns per inch, as previously described, and may comprise a second bi-component carbon yarn, such as that manufactured by or for William Barnet & Son, LLC and sold commercially under the trademark Nega-Stat® P210. The P210 yarn comprises carbon 33A enclosed (partially sheathed) in polyester 33B to provide surface contact for surface conductivity. The carbon 33A is partially exposed at three equally-spaced longitudinal slits formed along an entire length of the P210 yarn. According to its manufacturer, this yarn has been designed to provide optimum antistatic performance in end-products and end-uses where surface resistivity or surface conductivity is the required performance parameter.

In other exemplary embodiments, alternative conductive elements may be incorporated in the present fabric structure 20 in substitution of the core unit 31 and outside textile cover 33 of the multi-wrapped hybrid yarn Y3. Examples of such conductive elements are provided in prior U.S. Publication No. 2013/0180027 (the '027 Application). The complete disclosure of this prior publication is incorporated herein by reference. Specifically, the '027 Application, describes various alternative conductive elements made of multi-filament metal wire, such as stainless steel, filaments or of staple fibers where conductive particles are embedded in thermoplastic fiber, such as polyester, nylon, polypropylene, and acrylic. As stated in the '027 Application, the conductive particles can be in micrometer (mm) or nanometer (nm) size. The conductive particles can be embedded across the whole cross section of the thermoplastic fiber, or in core-sheath pattern where the conductive particles can be in the sheath region or in the core region. The conductive particles can also be embedded in the cross section of the thermoplastic fiber in a predetermined pattern.

In other implementations, the conductive fibers of the fabric structure 20 can be made by metal deposition on the yarn's surface, or by a process of depositing a conductive "metal" layer on the outer surface of a synthetic fiber by chemical reaction reduction-oxidation, where a layer of copper or silver is applied to fiber surfaces. The conductive fibers can be commingled with or wrapped by a nonconductive filament yarn. The non-conductive filament yarns may also contain fibers coated with a conductive polymer, also for surface exposure. The conductive fibers (staples) can be blended with nonconductive fiber at a predetermined ratio. Other examples of commercially available conductive fibers include, e.g.: S-SHIELD™ PES conductive fibers of 80% polyester and 20% Inox, as available from Schoeller Textiles AG, of Switzerland; CONDUCTROL® conductive fibers of acrylic polymer suffused to carbon fibers, as available from Sterling Chemicals International, Inc., of Houston, Tex. U.S.A.; BELLTRON® conductive fibers with a polymer matrix (nylon or polyester) and conductive particles (carbon or metal) exposed on the surface, as available from Kanebo Ltd., of Tokyo, Japan; and MEGATOPIA™ conductive fibers, as available from Toray Industries, Inc., of Japan.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A multi-bar warp knit fabric structure integrally formed in courses and wales using at least two guide bars of a textile knitting machine, said fabric structure comprising:

a body yarn adapted for being supplied from a first warp beam and manipulated by a first guide bar of the textile knitting machine;

a hybrid yarn adapted for being supplied from a second warp beam and manipulated by a second guide bar of the textile knitting machine, wherein said hybrid yarn comprises:

(i) a core unit;

(ii) an inside textile cover comprising a static-dissipative yarn helically wrapped around said core unit; and (iii) an outside textile cover comprising a surface-conductive yarn helically wrapped around said inside textile cover and said core unit;

wherein said hybrid yarn is integrally knit with said body yarn in a repeating stitch pattern alternately zigzaging lengthwise up selected wales of said fabric structure and floating across said fabric structure in a widthwise course direction, and said hybrid yarn cooperating with like knitted hybrid yarns to form a continuous conductive matrix of static dissipative boxes in said fabric structure.

2. The warp knit fabric structure according to claim 1, wherein said inside and outside textile covers of said hybrid yarn are helically wrapped in opposite directions.

3. The warp knit fabric structure according to claim 1, wherein said inside textile cover of said hybrid yarn comprises a bi-component fully sheathed carbon yarn.

4. The warp knit fabric structure according to claim 1, wherein said outside textile cover of said hybrid yarn comprises a bi-component partially sheathed carbon yarn.

5. The warp knit fabric structure according to claim 1, wherein said core unit of said hybrid yarn comprises copper suffused in a fiber selected from a group consisting of polyester and nylon.

6. The warp knit fabric structure according to claim 1, wherein said core unit of said hybrid yarn comprises ceramic particles.

7. The warp knit fabric structure according to claim 1, wherein said core unit of said hybrid yarn comprises a metal selected from a group consisting of silver, copper, gold, zinc, molybdenum, cobalt, and nickel.

8. The warp knit fabric structure according to claim 1, wherein said body yarn comprises polyester.

9. The warp knit fabric structure according to claim 1, and comprising an antimicrobial yarn run up selected wales of said fabric structure and passing centrally through a column of static dissipative boxes in said fabric structure.

10. The warp knit fabric structure according to claim 9, wherein said antimicrobial yarn comprises copper suffused in a fiber selected from a group consisting of polyester and nylon.

11. The warp knit fabric structure according to claim 10, wherein said antimicrobial yarn is integrally knit with selected wales of said fabric structure, and adapted for being supplied from a third warp beam and manipulated by a third guide bar of the textile knitting machine.

12. The warp knit fabric structure according to claim 1, wherein said hybrid yarn is integrally knit with said body yarn such that the continuous conductive matrix of static dissipative boxes operatively contacts both a technical face and a technical back of said fabric structure.

13. A multi-bar warp knit fabric structure integrally formed in courses and wales using at least two guide bars of a textile knitting machine, said fabric structure comprising:

a first polyester yarn adapted for being supplied from a first warp beam and manipulated by a first guide bar of the textile knitting machine;

a second polyester yarn adapted for being supplied from a second warp beam and manipulated by a second guide bar of the textile knitting machine;

a hybrid yarn adapted for being supplied from a third warp beam and manipulated by a third guide bar of the textile knitting machine, wherein said hybrid yarn comprises:

(i) a core unit;

(ii) an inside textile cover comprising a static-dissipative yarn helically wrapped around said core unit; and (iii) an outside textile cover comprising a surface-conductive yarn helically wrapped around said inside textile cover and said core unit;

wherein said hybrid yarn is integrally knit with said fabric structure in a repeating stitch pattern alternately zigzaging lengthwise up selected wales of said fabric structure and floating across said fabric structure in a widthwise course direction, and said hybrid yarn cooperating with like knitted hybrid yarns to form a continuous conductive matrix of static dissipative boxes in said fabric structure; and an antimicrobial yarn integrally knit with selected wales of said fabric structure, and adapted for being supplied from a fourth warp beam and manipulated by a fourth guide bar of the textile knitting machine.

14. The warp knit fabric structure according to claim 13, wherein said inside and outside textile covers of said hybrid yarn are helically wrapped in opposite directions.

15. The warp knit fabric structure according to claim 13, wherein said inside textile cover of said hybrid yarn comprises a bi-component fully sheathed carbon yarn.

16. The warp knit fabric structure according to claim 13, wherein said outside textile cover of said hybrid yarn comprises a bi-component partially sheathed carbon yarn.

17. The warp knit fabric structure according to claim 13, wherein said core unit of said hybrid yarn comprises copper suffused in a fiber selected from a group consisting of polyester and nylon.

18. The warp knit fabric structure according to claim 13, wherein said core unit of said hybrid yarn comprises ceramic particles.

19. The warp knit fabric structure according to claim 13, and comprising an antimicrobial yarn run up selected wales of said fabric structure and passing centrally through a column of static dissipative boxes in said fabric structure.

20. A textile component adapted for being integrated in a warp knit fabric structure, said textile component comprising a hybrid yarn adapted for being supplied from a warp beam and manipulated by a guide bar of a textile knitting machine, wherein said hybrid yarn comprises:

(i) a core unit;

(ii) an inside textile cover comprising a static-dissipative, bi-component, fully sheathed carbon yarn helically wrapped around said core unit; and (iii) an outside textile cover comprising a surface-conductive, bi-component, partially sheathed carbon yarn helically wrapped in an opposite direction around said inside textile cover and said core unit;

wherein said hybrid yarn is adapted for being integrally knit with a body yarn in a repeating stitch pattern alternately zigzaging lengthwise up selected wales of the fabric structure and floating across the fabric structure in a widthwise course direction, and said hybrid yarn cooperating with like knitted hybrid yarns to form a continuous conductive matrix of static dissipative boxes in the fabric structure.

* * * * *